US009774955B2

(12) United States Patent
Wang et al.

(10) Patent No.: US 9,774,955 B2
(45) Date of Patent: Sep. 26, 2017

(54) SPEAKER

(71) Applicants: Hongxing Wang, Shenzhen (CN); Lubin Mao, Shenzhen (CN); Shun Guo, Shenzhen (CN)

(72) Inventors: Hongxing Wang, Shenzhen (CN); Lubin Mao, Shenzhen (CN); Shun Guo, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/006,428

(22) Filed: Jan. 26, 2016

(65) Prior Publication Data

US 2016/0381481 A1 Dec. 29, 2016

(30) Foreign Application Priority Data

Jun. 29, 2015 (CN) ..... 2015 2 0456197 U

(51) Int. Cl.
*H04R 9/02* (2006.01)
*H04R 9/04* (2006.01)

(52) U.S. Cl.
CPC ..... *H04R 9/025* (2013.01); *H04R 9/047* (2013.01); *H04R 9/046* (2013.01); *H04R 2209/022* (2013.01); *H04R 2209/024* (2013.01); *H04R 2499/11* (2013.01)

(58) Field of Classification Search
CPC . H04R 9/025; H04R 9/06; H04R 9/08; H04R 9/047; H04R 2209/021; H04R 2209/022; H04R 2209/024; H04R 2499/11; H04R 2499/15
See application file for complete search history.

(56) References Cited

U.S. PATENT DOCUMENTS 3,699,249 A * 10/1972 Crane ..... H02K 41/0356 336/200
4,544,805 A * 10/1985 Sawafuji ..... H04R 7/04 181/173
2012/0163651 A1* 6/2012 Zhang ..... H04R 9/025 381/407

* cited by examiner

*Primary Examiner* — Joshua Kaufman
(74) *Attorney, Agent, or Firm* — Na Xu; IPro, PLLC

(57) ABSTRACT

A speaker includes a vibration system including a vibrating diaphragm and a flat voice coil for driving the vibrating diaphragm; a magnetic circuit system including two separated permanent magnets with opposite magnetic poles thereof facing each other; a magnetic gap formed between the permanent magnets for partially receiving the flat voice coil; and a housing for accommodating the vibrational system and the magnetic circuit system. Magnetic conductive plates are attached to external surfaces of the permanent magnets. The housing includes a through-hole with a shape matched with the magnetic conductive plates, a wall of the housing has support steps located in the through-hole, and the magnetic conductive plates are placed in the through-hole and are fixed on the support steps.

5 Claims, 3 Drawing Sheets

SPEAKER

FIELD OF THE INVENTION

The present disclosure relates to electro-acoustic transducers, more particularly to a speaker having a diaphragm driven by a voice coil.

DESCRIPTION OF RELATED ART

With the rapid development of technology, audio devices are more and more popular. The people require not only the audio playing function of the audio devices, but also require higher reliability of audio devices. As more mobile multimedia technologies are developed particularly in 3G era, many audio devices are provided with many entertainment features, such as video playback, digital camera, games, GPS navigation and so on, more sophisticated and compact electronic components are required in audio devices.

The speaker is a common electronic component in audio devices and is used mainly for playback of audio signals. In the existing audio devices, the thickness of mobile phone, for example, is smaller, so that the speaker shall be thinner also. If the speaker is too thin, the vibration amplitude of the vibrating diaphragm is reduced, that will affect seriously the low frequency performance of the speaker. Therefore, the existing long stroke speaker with better low frequency performance is developed and the thickness is small enough, so that such a speaker can solve well the problems of traditional speaker. The magnetic circuit system of the long stroke speaker includes usually two pairs of magnets separated each other as drive magnets. The voice coil of the vibration system moves in reciprocating mode in the magnet gap between the magnets. However, the magnetic flux leakage in the magnetic circuit system of the long stroke speaker is serious. The vibration amplitude of the voice coil is difficult to be controlled. The voice coil is easier to tear the vibrating diaphragm in larger vibration amplitude; and the sound quality is affected.

Therefore, it is necessary to provide a new speaker to overcome the problems mentioned above.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment. To make the technical problems to be solved, technical solutions and beneficial effects of present disclosure more apparent, the present disclosure is described in further detail together with the figures and the embodiment. It should be understood the specific embodiment described hereby is only to explain this disclosure, not intended to limit this disclosure.

Figure 1:
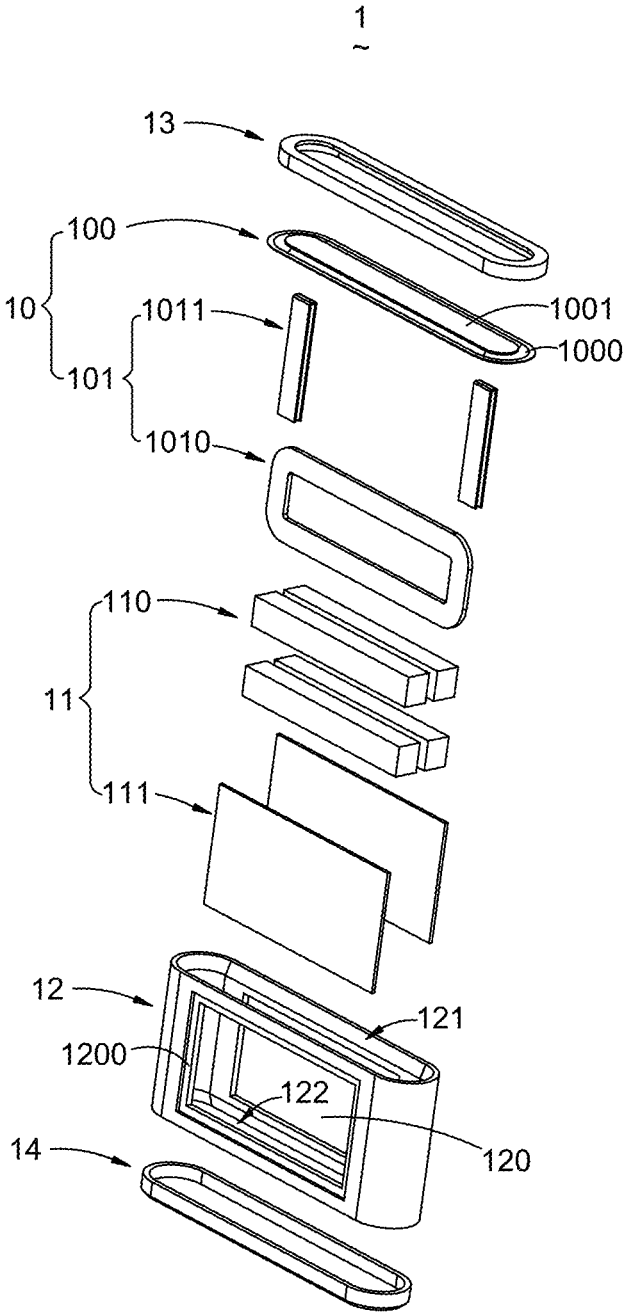
FIG. 1 is an isometric exploded view of a speaker in accordance with an exemplary embodiment of the present disclosure.
Figure 2:
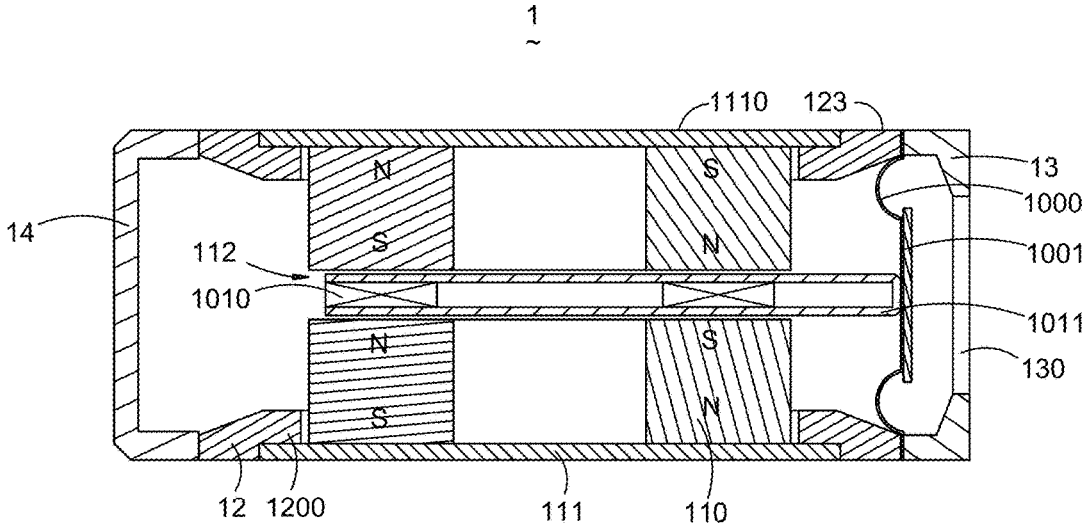
FIG. 2 is a cross-sectional view of the speaker in FIG. 1.
Figure 3:
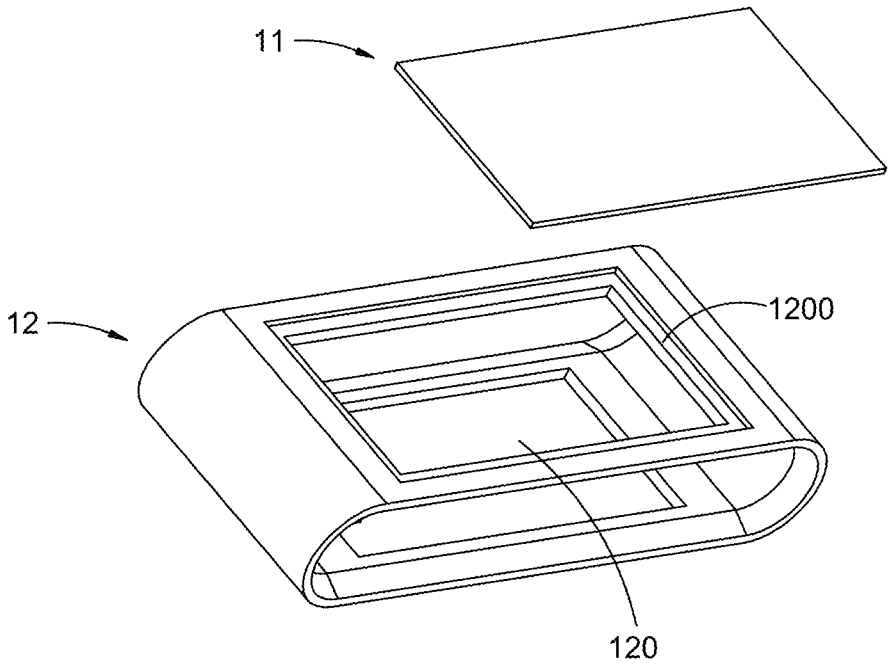
FIG. 3 is an isometric exploded view of a housing and a magnetic conductive plate of the speaker.

As shown in FIGS. 1-3, a speaker 1 in accordance with an exemplary embodiment of the present disclosure, includes a vibration system 10, a magnetic circuit system 11, a housing 12 for assembling the vibration system 10 and the magnetic circuit system 11, a front cover 13 and a rear cover 14 assembled on the housing 12 to create a space to accommodate the vibration system 10 and the magnetic circuit system 11.

The magnetic circuit system 11 includes at least two permanent magnets 110 separated from each other, opposite magnetic poles thereof being faced to each other. The magnetic circuit system 11 further includes a magnetic conductive plate 111 attached to each of the permanent magnet 110. The gap between the permanent magnets 110 is defined as a magnetic gap 112. In this embodiment, the amount of the permanent magnets is four, as shown in FIG. 2.

The vibration system 10 includes a vibrating diaphragm 100 with an edge thereof fixed on the housing 12 and a flat voice coil 101 which drives the vibrating diaphragm 100 to vibrate. One end of the flat voice coil is suspended in the magnetic gap 112. The vibrating diaphragm 100 includes a suspension 1000 with a periphery thereof fixed on the housing 12, and a center dome top 1001 connected to the suspension 1000. The flat voice coil 101 includes a voice coil wire 1010 in flat and annular shape and a coil bracket 1011 with one end fixed on the center dome top 1001. The voice coil wire 1010 is fixed on the voice coil bracket 1011. The voice coil wire 1010 vibrates in reciprocating mode in the magnetic gap 112 along the vibration direction X-X of the vibration system 10. The vibration of the voice coil wire 1010 is transferred to the vibrating diaphragm 100 through the coil bracket 1011 to drive the vibrating membrane 100 to vibrate and make sound.

As shown in FIG. 3, the housing 12 is provided with a through-hole 120 with a shape matched with the magnetic conductive plate 111. A wall of the housing 12 is provided with a support step 1200 located in the through-hole 120. The magnetic conductive plate 111 is placed in the through-hole 120 and is fixed on the support step 1200. An external surface 1110 of the magnetic conductive plate 111 and an external surface 123 of the housing 12 are in a same plane. There are two magnetic conductive plates 111, arranged symmetrically in the magnetic circuit system 11. The support step 1200 can not only increase the contact area between the magnetic conductive plate 111 and the housing 12, but also can prevent effectively the permanent magnets 110 from contacting each other due to the attraction between the permanent magnets 110, and increase greatly the structure stability of the entire magnetic circuit system 11. In addition, as the magnetic conductive plate 111 is placed in the through-hole 120, the thickness of the speaker 1 can be reduced further.

The cross section of the housing 12 is a runway tubular shape. The housing 12 includes a front opening 121 for assembling the vibrating diaphragm 100 and a rear opening 122 relative to the front opening 121. The front opening 121 and the rear opening 122 are communicated with each other. The speaker 1 also includes a front cover 13 for assembling the front opening 121 and a rear cover 14 for assembling the rear opening 122. The circumferential edge of the vibrating diaphragm 100 is fixed between the front cover 13 and the housing 12. The front cover 13 is provided with a sound outlet 130. The suspension of the vibrating diaphragm 100 is fixed on the front opening 121, and the center dome top 1001 is connected to the suspension 1000.

In the speaker 1 disclosed in this disclosure, the vibrating diaphragm 100 can have bigger vibration amplitude, so the speaker 1 has a better low-frequency sound effect. In addition, the support step 1200 provided in the through-hole 120 can fix the magnetic conductive plate 111 in the through-hole 120. The magnetic circuit system 11 can be fixed firmly, and not easy to be displaced.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a vibration system including a vibrating diaphragm and a flat voice coil for driving the vibrating diaphragm;

a magnetic circuit system including at least two permanent magnets, which are separated from each other with opposite magnetic poles thereof facing each other, and magnetic conductive plates attached to external surfaces of the permanent magnets;

a magnetic gap formed between the permanent magnets for partially receiving the flat voice coil;

a housing for accommodating the vibrational system and the magnetic circuit system;

wherein the housing includes a through-hole with a shape matched with the magnetic conductive plates, a wall of the housing has support steps located in the through-hole, and the magnetic conductive plates are placed in the through-hole and are overlapped on the support steps, an external surface of the magnetic conductive plate being coplanar with an external surface of the housing.

2. The speaker according to claim 1, wherein the housing includes a front opening for assembling the vibrating diaphragm and a rear opening corresponding to and communicating with the front opening.

3. The speaker according to claim 2 further including a front cover for the front opening and a rear cover for the rear opening, and an edge of the vibrating diaphragm is fixed between the front cover and the housing.

4. The speaker according to claim 1, wherein the vibrating diaphragm includes a suspension with a periphery thereof fixed on the housing, and a center dome top connected to the suspension.

5. The speaker according to claim 4, wherein the flat voice coil includes a voice coil wire and a coil bracket with one end fixed on the center dome top.

* * * * *